US010088124B2

(12) United States Patent
Marquardt

(10) Patent No.: US 10,088,124 B2
(45) Date of Patent: Oct. 2, 2018

(54) DYNAMIC OPTIC

(71) Applicant: ABL IP Holding LLC, Decatur, GA (US)

(72) Inventor: Craig Eugene Marquardt, Covington, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 15/375,342

(22) Filed: Dec. 12, 2016

(65) Prior Publication Data

US 2017/0167690 A1 Jun. 15, 2017

Related U.S. Application Data

(60) Provisional application No. 62/266,061, filed on Dec. 11, 2015.

(51) Int. Cl.

| | |
|---|---|
| ***F21V 9/12*** | (2006.01) |
| ***F21V 7/00*** | (2006.01) |
| ***F21V 7/10*** | (2006.01) |
| ***F21V 7/22*** | (2018.01) |

(52) U.S. Cl.

CPC ..... *F21V 7/0091* (2013.01); *F21V 7/10* (2013.01); *F21V 7/22* (2013.01); *F21V 9/12* (2013.01)

(58) Field of Classification Search

CPC . F21V 7/0091; F21V 7/10; F21V 7/22; F21V 5/04; F21V 9/12; B63B 45/06; F21Y 2115/10

See application file for complete search history.

(56) References Cited

U.S. PATENT DOCUMENTS

| | | | | |
|---|---|---|---|---|
| 5,684,579 | A * | 11/1997 | Ohtomo | G01C 5/02 356/148 |
| 6,088,090 | A * | 7/2000 | Hoshi | G01B 11/26 356/139.1 |
| 6,655,810 | B2 * | 12/2003 | Hayashi | G01D 11/28 362/318 |
| 7,299,557 | B2 * | 11/2007 | Lippuner | G01C 9/06 33/366.12 |
| 7,388,658 | B2 * | 6/2008 | Glimm | G01C 1/02 356/138 |
| 7,692,777 | B1 * | 4/2010 | Monz | G01C 9/20 356/139.1 |
| 2011/0128745 | A1 * | 6/2011 | Chen | F21V 5/04 362/311.02 |

* cited by examiner

*Primary Examiner* — Peggy Neils

(74) *Attorney, Agent, or Firm* — Kilpatrick Townsend & Stockton LLP

(57) ABSTRACT

A dynamic optic includes at least one optic having a reservoir that is at least partially filled with a liquid and at least one light source disposed adjacent to the at least one optic. The upper surface of the liquid creates a total internal reflection surface that totally internally reflects light emitted by the at least one light source.

20 Claims, 6 Drawing Sheets

DYNAMIC OPTIC

CROSS REFERENCE TO RELATED APPLICATION

This application is related to and claims priority benefit from U.S. Provisional Application No. 62/266,061 ("the '061 application"), filed on Dec. 11, 2015, entitled DYNAMIC OPTIC. The '061 application is hereby incorporated in its entirety by this reference.

FIELD OF THE INVENTION

Embodiments of the invention relate to dynamic optics able to consistently direct light onto a target area regardless of the orientation of the optic relative to the target area, as well as light engines incorporating such dynamic optics.

BACKGROUND

Controlling the direction of emitted light from a light engine so as to illuminate the desired target area is typically accomplished using an optic having the reflective and/or refractive properties needed to achieve the desired directionality of the light. Consistent illumination of the desired target area may be achievable when the light engine is stationary, but can be extremely difficult when the light engine is in motion (e.g., on a ship, airplane, etc.). As the orientation of the light engine changes relative to the target area, so too does the direction of the light emitted from the light engine relative to the target area. Thus, multiple light engines having different illumination patterns may need be provided in such situations to ensure that the target area will be illuminated at all times. Alternatively, light engines may be provided with complicated mechanism for altering the orientation of the optic within the light engine to thereby alter the directionality of light emitted from the light engine. Both of these alternatives are expensive and prone to failure.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Embodiments of the present invention provide a dynamic optic that automatically adjusts to changes in the orientation of the light engine relative to the target area to ensure consistent illumination of the target area even when the light engine is moving relative to the target area.

According to certain embodiments of the present invention, a dynamic optic comprises at least one optic having a reservoir that is at least partially filled with a liquid and at least one light source disposed adjacent to the at least one optic such that the at least one light source emits light that interacts with an upper surface of the liquid at a total internal reflection surface.

DETAILED DESCRIPTION

Figure 1:
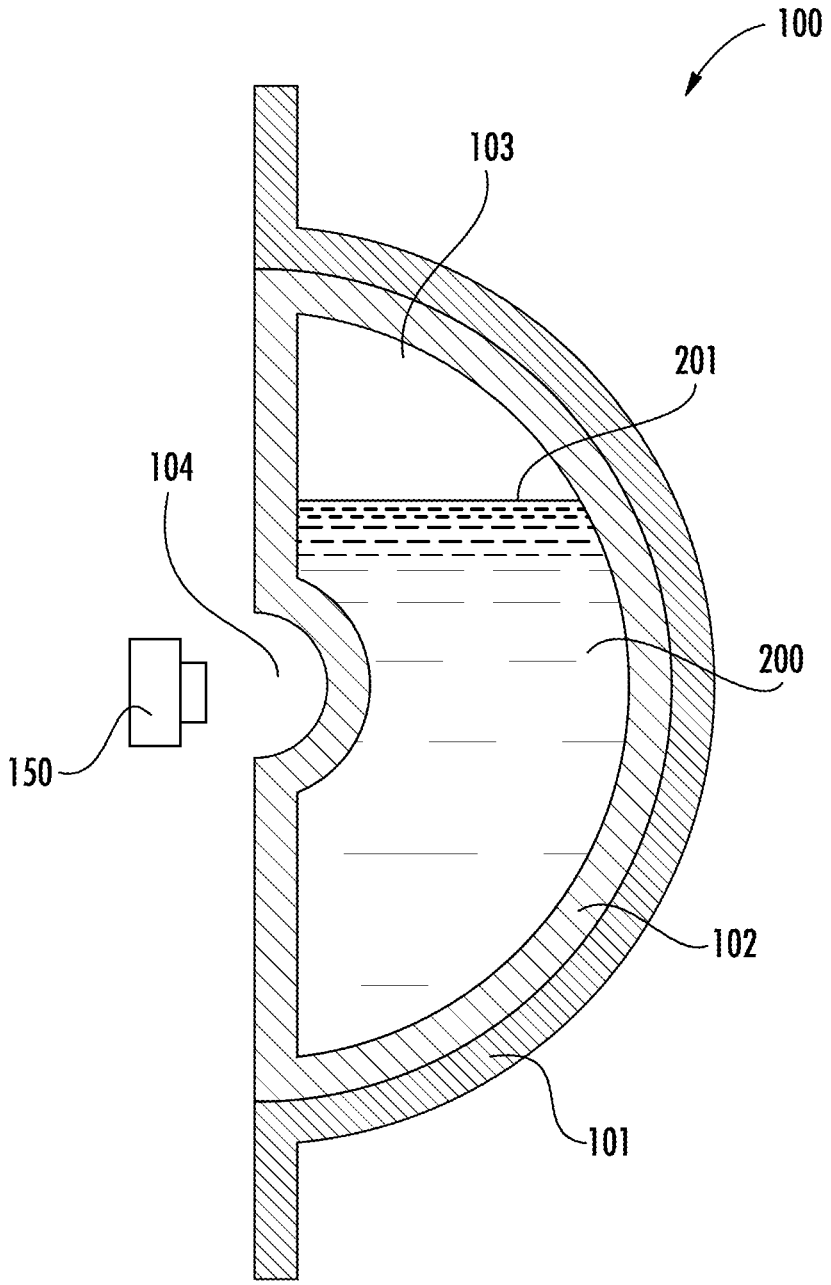
FIG. 1 is a cross-sectional view of an optic according to one embodiment of the present invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

FIGS. 1 and 4A-4C illustrate one embodiment of a dynamic optic 100 contemplated herein. The dynamic optic 100 includes an outer optic 101 coupled with an inner optic 102. The inner optic 102 and outer optic 101 may be of any shape, and such shape is not limited to the semi-circular cross-sectional shown in FIG. 1. Moreover, the inner optic 102 and outer optic 101 need not have the same cross-sectional shape. Rather, the outer optic 101 may be shaped to have any geometry that, in combination with the inner optic 102, produces the desired light output from the optic 100.

At least one reservoir 103 is defined in the inner optic 102. The reservoir 103 may be of any size and be formed of any suitable three-dimensional shape, including, but not limited to, a cube or box (see FIG. 3), cone, pyramid, cylinder, sphere, a partial sphere, semi-circle, etc. A plurality of reservoirs 103 may be provided in the inner optic 102.

In other embodiments, one or more reservoirs 103 may be provided in the outer optic 101. Such reservoirs 103 may be provided in addition to or instead of the one or more reservoirs provided in the inner optic 102. In still other embodiments, only a single optic having one or more reservoirs may be used. For example, an alternative embodiment of the dynamic optic 100 may be similar to the embodiment of FIG. 1 but without the outer optic 101. Alternatively, embodiments of the dynamic optic 100 may include one or more additional optical layers above, below, and/or between the outer and inner optics 101 and 102. The dynamic optic 100 and its constituent optic layers (e.g., outer optic 101, inner optic 102, etc.) may be formed of glass, silicone, acrylic, or any other appropriate material. In some embodiments, the dynamic optic is molded silicone. The outer optic 101 (if provided) can be coupled to the inner optic 102 in various ways, including, but not limited to, by molding the outer optic 101 over the inner optic 102 and/or by adhering the outer and inner optic together.

In some embodiments, the various optics (e.g., outer optic 101, inner optic 102, etc.) each have different optical properties. The speed of light depends on the material properties of the object through which the light is travelling (i.e., air, water, glass, plastic, etc.) and all materials have an index of refraction (n) to define the speed at which light passes through the respective material. In addition, based on the index of refraction and the associated speed, the angle of incidence (i.e., the angle with respect to the normal direction of the surface of the object through which the light passes) changes as light moves from one material to another (i.e., from air into a lens). In other words, the travel direction of light "bends" as it passes from a first material to a second material. Further, the amount of bending that occurs when the light enters the second material is proportional to the ratio of the indices of refraction of the first and second materials such that less bending will occur if the two materials have similar indices of refraction. Accordingly, the dynamic optic 100 can be designed with different indices of refraction for outer optic 101 and inner optic 102 to create a bend in light that passes through the interface between these optics.

The reservoir 103 of the inner optic 102 is at least partially filled with a liquid 200 having the desired optical properties. In some embodiments, the inner optic 102 includes a hole to allow liquid 200 to be added to the reservoir 103. The hole may disposed on a surface of the inner optic 102 intended to interface with the outer optic 101 such that, when the outer optic 101 is molded/attached/adhered to the inner optic 102 the hole is sealed. In some embodiments, the hole may include a plug for closing/sealing the reservoir 103. In certain embodiments, the liquid 200 is a liquid silicone having a different index of refraction than the inner optic 102 and/or outer optic 101. The liquid silicone used preferably is able to retain its viscosity (i.e., not thicken or turn solid) over a reasonable period of time. Suitable liquid silicones include products available from Dow Corning.

The dynamic optic 100 may be positioned adjacent one or more light sources 150 (e.g., light emitting diode (LED), fluorescent, incandescent, xenon, halogen, or any other light source). In some embodiments, at least one cavity or recess 104 is located on the lower surface of the inner optic 102 to at least partially receive and accommodate the one or more light sources 150. The recess 104 can be of any shape to accommodate the one or more light sources 150. As shown in FIGS. 1 and 4A-4C, the shape of the recess 104 may approximately correspond to the shape of the reservoir 103 or the outer surface of the inner optic 102 and be approximately semi-spherical or semi-cylindrical. However, in other embodiments, the shape of the recess is dissimilar to the shape of the outer surface of the inner optic 102 and/or the shape of the reservoir 103.

Figure 2:
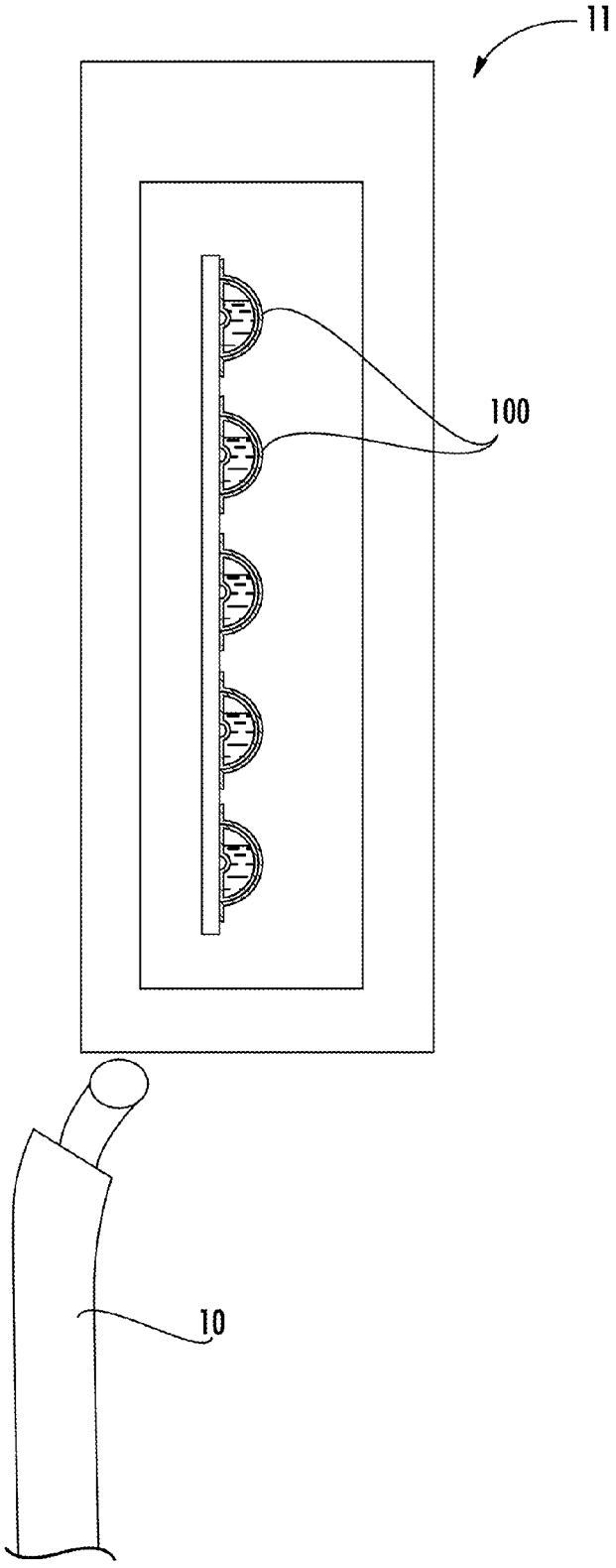
FIG. 2 is a side view of an embodiment of a light engine provided with optics of FIG. 1.

In use, the dynamic optic 100 of FIG. 1 can be positioned within a light engine 11 so as to direct lighted emitted by the light source 150. FIG. 2 schematically illustrates an embodiment of a light engine 11 housing a plurality of dynamic optics 100 of FIG. 1. The light engine is mounted on a pole 10 and may be attached so as to be tiltable, rotatable, or otherwise adjustable relative to the pole 10. The dynamic optics disclosed herein may be used in any type of light engine and their use is not limited to the particular light engines or fixtures illustrated in the figures. Moreover, the dynamic optics 100 disclosed herein may be used in any application.

Figure 4A:
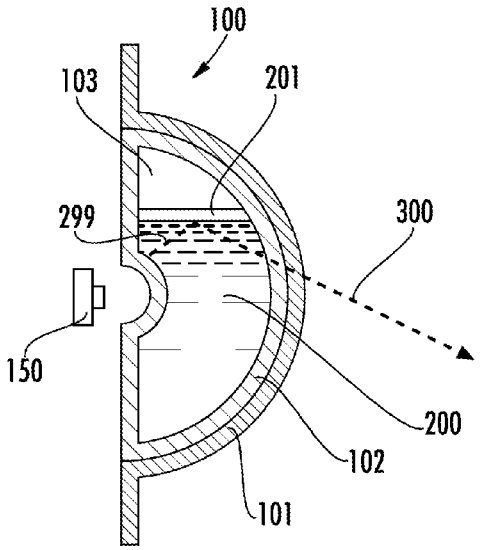
FIGS. 4A, 4B, and 4C are cross-sectional views of the optic of FIG. 1 in different orientations.
Figure 4B:
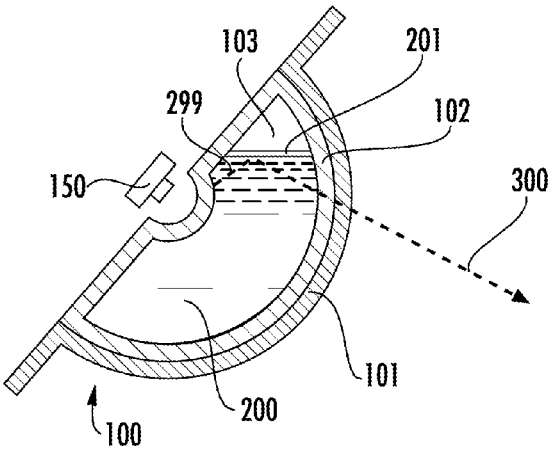
Figure 4C:
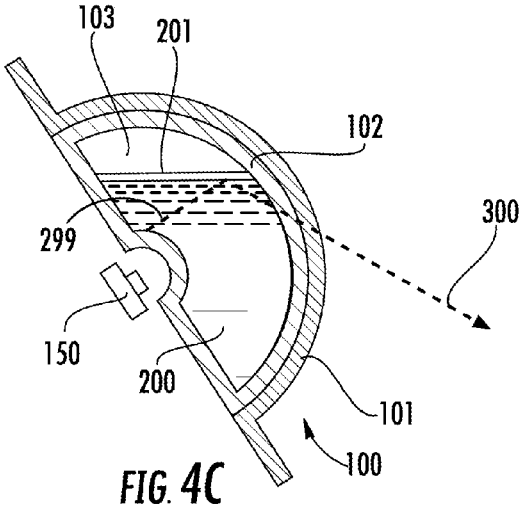
Figure 4D:
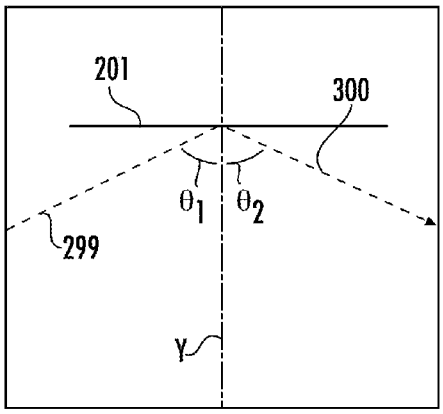
FIG. 4D is a schematic diagram of a total internal reflectance surface of the optic of FIG. 1.

As illustrated in FIGS. 4A-4C, emitted light from the light source 150 moves through the liquid 200 in the reservoir 103 until it encounters the upper surface of the liquid 200, which creates a total internal reflection (TIR) surface 201 that reflects the light at a predetermined angle and in a predetermined direction based on the location of the light source 150 and the surface of the liquid 200. As shown in FIGS. 4A-4C, even when the orientation of the dynamic optic 100 changes, the TIR surface 201 of the dynamic optic 100 always remain horizontal (due to gravity) to thereby direct the emitted light 300 at a constant or approximately constant TIR angle. FIG. 4D shows a schematic diagram of light 299 emitted from a light source that encounters the TIR surface 201 at an incidence angle $\theta_1$ with respect to an axis Y (that is normal to the TIR surface 201) and the reflected light 300 that is reflected at an angle $\theta_2$ with respect to the axis Y (where $\theta_1=\theta_2$). In some embodiments, the range of TIR angles $\theta_1$, $\theta_2$ is from 10° to 60°; however, other angles are contemplated. Thus, the dynamic optic 100 automatically adjusts to changes in its orientation relative to the target area to ensure consistent illumination of the target area.

Figure 3A:
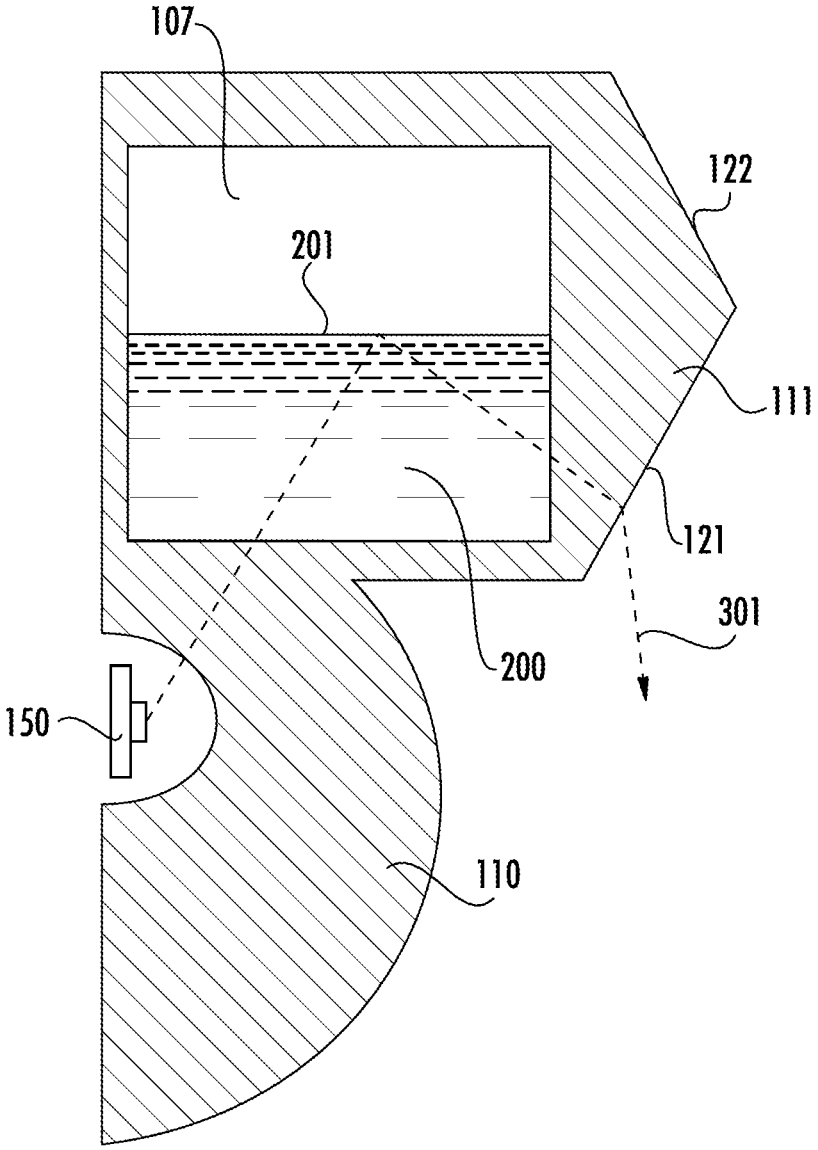
FIG. 3A is a cross-sectional view of an optic according to another embodiment of the present invention.
Figure 3B:
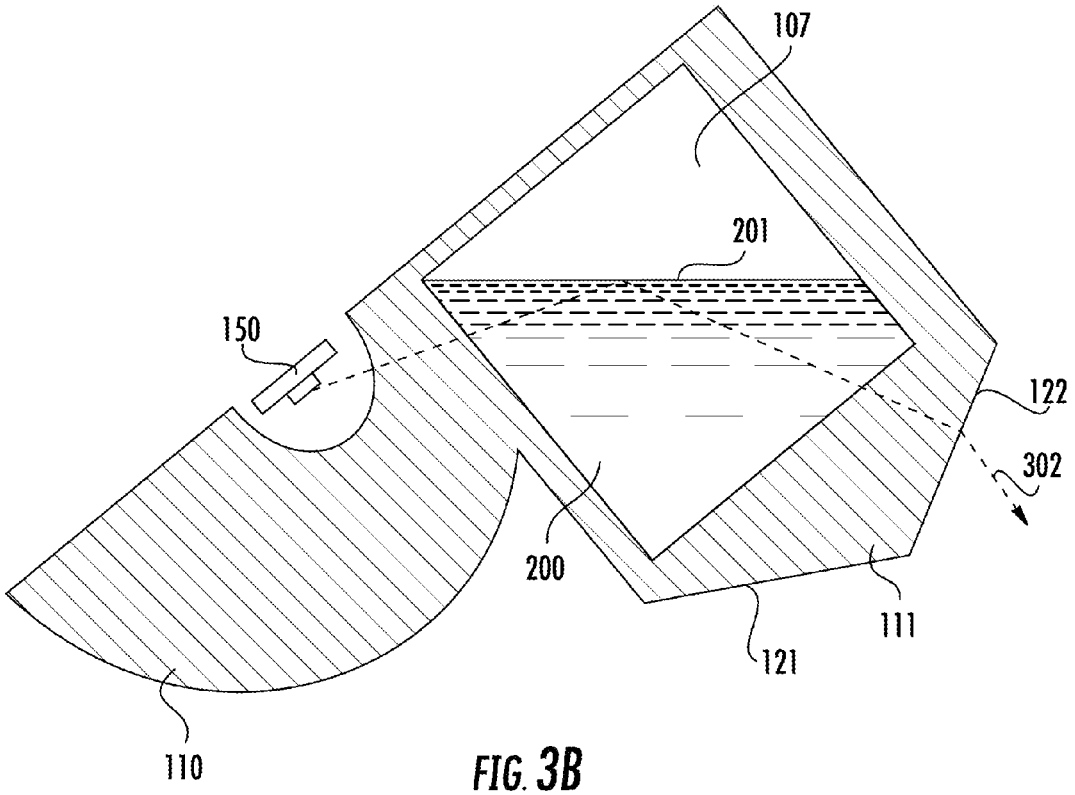
FIG. 3B is a cross-sectional view of the optic of FIG. 3A in a different orientation.

FIGS. 3A and 3B illustrate an alternate embodiment of a dynamic optic 100 contemplated herein. A reservoir 107 for holding liquid 200 (which can have any size, shape, etc.) is formed in the dynamic optic 100. The reservoir 107 may be provided at any location within the dynamic optic 100. As shown in FIGS. 3A and 3B, the reservoir 107 may have a rectangular or square cross-section. However, the reservoir 107 may have any appropriate shape.

The dynamic optic 100 of FIGS. 3A and 3B includes a lower portion 110 and an upper portion 111. The upper portion 111 and the lower portion 110 may be formed as a single continuous optical structure or, in some embodiments, are separate components bonded or otherwise attached to one another. Again, however, the dynamic optic 100 can be of any three-dimensional and cross-sectional shape.

As shown in FIGS. 3A and 3B, the lower portion 110 may be semi-spherical or semi-cylindrical and is a different shape than the upper portion 111. However, the lower portion 110 may have any appropriate shape and may match the shape of the upper portion 111.

In some embodiments, the upper portion 111 may be formed with one or more optical features for further directing light received from the TIR surface (i.e., the liquid boundary surface 201). For example, the dynamic optic 100 of FIGS. 3A and 3B is shaped to include first and second angled surfaces 121 and 122 adjacent the liquid reservoir 107. The dynamic optic 100 may include any number of optical features (e.g., a single optical feature, three or more optical features, etc.) and the optical features may have any appropriate shape (flat, curved, convex. concave, etc.) and surface texturing (including no surface texturing). Each optical feature may interface with light reflected by the TIR surface 201. For example, when the dynamic optic 100 is in a first position, light reflected by the TIR surface 201 will encounter and pass through a first optical feature, but when the dynamic optic 100 is in a second position, light reflected by the TIR surface 201 will encounter a second optical feature.

In the embodiment of FIGS. 3A and 3B, the reservoir 107 is disposed in the upper portion 111 of the dynamic optic 100 such that it is offset from the light source 150 when the dynamic optic 100 is positioned over the light source 150. By way of example, incorporation of the dynamic optic 100 and associated light source(s) 150 of FIGS. 3A and 3B in a vertically-mounted light engine would result in the liquid reservoir 107 disposed above the light source 150.

When the dynamic optic 100 is in an approximately vertical position (0° with respect to a vertical axis, as shown in FIG. 3A), light 301 emitted from the one or more light sources 150 is reflected by the TIR surface 201 toward the first angled surface 121, which can further direct the reflected light 301 as desired (e.g., via refraction). The light reflected from the TIR surface 201 may interface with the first angled surface 121 for a range of rotational orientations of the dynamic optic 100. For example, the dynamic optic 100 may rotate away from the approximately vertical position shown in FIG. 3A (e.g., see FIG. 3B) to a threshold angle with respect to a vertical axis. Up until that threshold angle, light reflected by the TIR surface 121 will all be directed toward the first angle surface 121. As shown in FIG. 3B, when the dynamic optic 100 rotates beyond the threshold angle, the light 302 reflected from the TIR surface 201 may then be directed toward the second angled surface 122. The second angled surface 122 can further direct the reflected light 302 as desired (e.g., via refraction). The threshold angle may be an angle in the range of 30°-60° from the vertical orientation shown in FIG. 3A. In some embodiments, the dynamic optic 100 may include a third optical feature such that if the dynamic optic 100 is tilted or rotated beyond a second threshold angle, light reflected from the TIR surface 201 will be directed toward the third optical feature. One of skill in the art will understand that the dynamic optic 100 can be shaped to have any enhancements or geometries that, in combination with the TIR surface 201 of the liquid 200, will create the desired light distribution.

The configuration of the first and second angled surfaces 121 and 122 adjacent the liquid reservoir 107 shown in FIGS. 3A and 3B is also compatible with the multiple layered optic embodiments shown in FIGS. 1 and 4A-4C. For example, the outer optic 101 may include one or more optical features.

Figure 5:
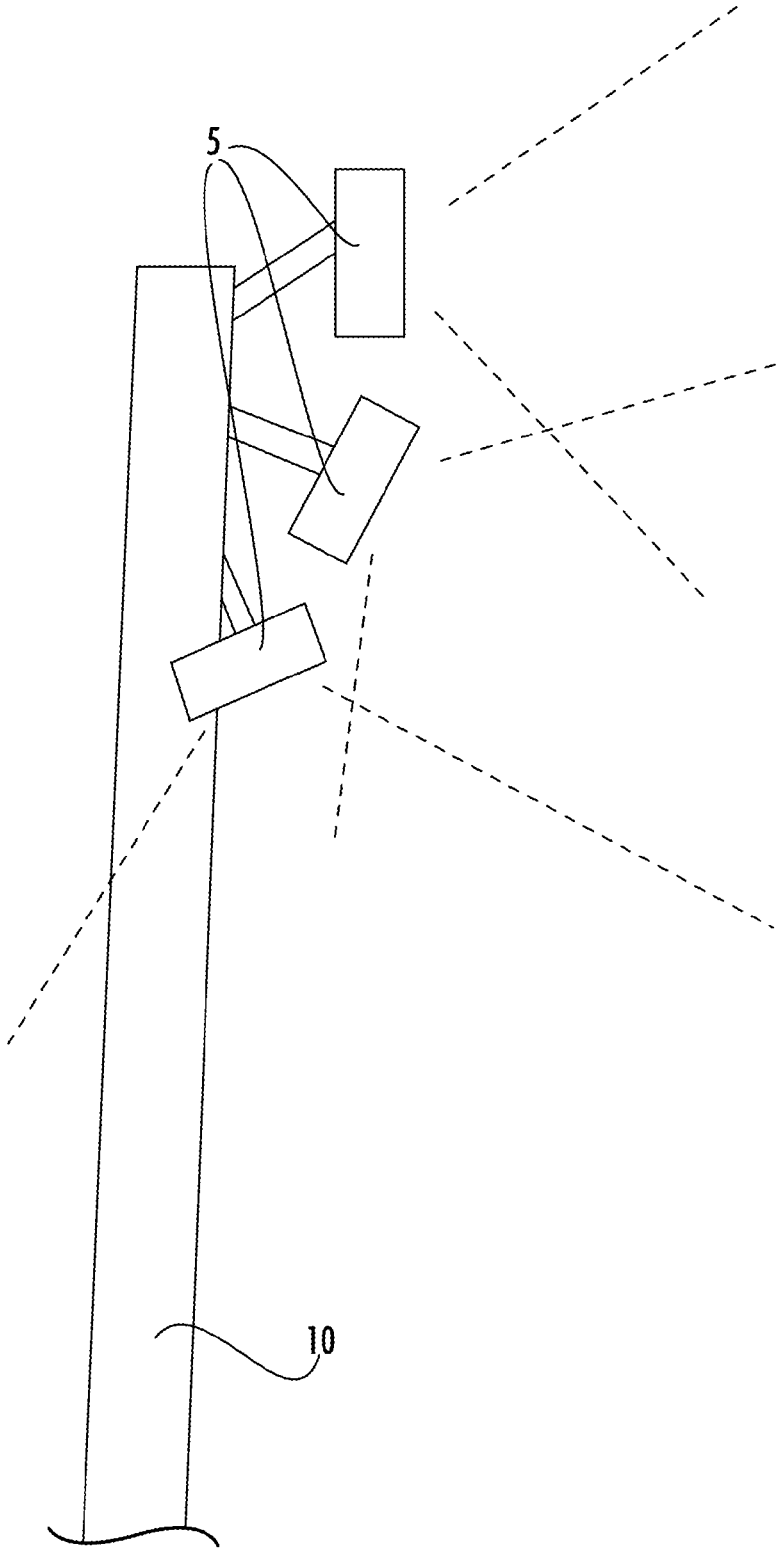
FIG. 5 is a schematic view of a plurality of light engines.

Some examples of applications where a dynamic optic may be useful are marine/boating and aerospace industries. For example, a boat or aircraft is prone to pitch or roll in various directions during use, and the associated light engines pitch and roll with the boat or aircraft. To compensate for this constant movement, boats for example are often equipped with a plurality of light engines oriented differently on the boat to ensure illumination of the desired target area (typically outwardly and downwardly from the boat) regardless of the pitch of the boat. Such a configuration is illustrated in FIG. 5 whereby three light engines 5 are mounted in three different orientations on the mast 10 of a ship. Because a light engine provided with the dynamic optics disclosed herein is able to emit light in a constant direction regardless of the orientation of the light engine (as described above), the array of multiple light engines shown in FIG. 5 becomes unnecessary. In other words, inclusion of one or more of the dynamic optics described herein in a single light engine can replace the need for an array of multiple light engines to illuminate a desired area. Thus, fewer light engines are needed, which yields cost savings, energy savings, reduction in weight, and reduced wiring complexity, among other benefits.

The dynamic optics shown in the Figures are solely for purposes of illustration, and embodiments of the light engines disclosed herein are not limited to use only with LEDs, much less only the illustrated embodiments. Moreover, the dynamic optics 100 disclosed herein may be provided as discrete optics (each with a dedicated light source) or alternatively can be provided as a linear optic that directs the emitted light of multiple light sources.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A light assembly comprising:

a dynamic optic comprising an outer optic and an inner optic disposed adjacent an inner surface of the outer optic, wherein at least one of the inner optic or the outer optic comprises at least one reservoir that is at least partially filled with a liquid, wherein an upper surface of the liquid forms a total internal reflection surface; and at least one light source disposed adjacent to the inner optic and fixed to the dynamic optic, the at least one light source movable with the dynamic optic, wherein at least some of the light emitted by the at least one light source is reflected by the total internal reflection surface.

2. The light assembly of claim 1, wherein the total internal reflection surface extends in a plane and wherein the plane does not change regardless of the rotational orientation of the dynamic optic.

3. The light assembly of claim 1, wherein the inner optic comprises the at least one reservoir.

4. The light assembly of claim 1, wherein the inner optic comprises a recess on a lower surface of the inner optic to accommodate the at least one light source.

5. The light assembly of claim 4, wherein the recess comprises a shape that approximately corresponds to a shape of an outer surface of the inner optic.

6. The light assembly of claim 1, wherein the liquid comprises a liquid silicone having an different index of refraction than the inner optic.

7. The light assembly of claim 1, wherein the inner optic comprises a hole to allow the liquid to be added to the reservoir.

8. The light assembly of claim 7, wherein the hole is disposed on a surface of the inner optic that interfaces with the outer optic such that, when the outer optic is attached to the inner optic, the hole is sealed.

9. The light assembly of claim 1, wherein the total internal reflection surface extends in a plane and wherein the total internal reflection surface reflects light at an angle from 10° to 60° with respect to an axis normal to the plane.

10. The light assembly of claim 1, wherein the outer optic comprises (i) a first optical feature towards which light reflected by the total internal reflection surface is directed when the dynamic optic is in a first rotational orientation and (ii) a second optical feature towards which light reflected by the total internal reflection surface is directed when the dynamic optic is in a second rotational orientation different from the first rotational orientation, wherein no light reflected by the total internal reflection surface is directed toward the second optical feature when the dynamic optic is in the first rotational orientation.

11. The light assembly of claim 10, wherein the dynamic optic rotates beyond a threshold angle to move from the first rotational orientation to the second rotational orientation.

12. A light assembly comprising:

a dynamic optic comprising at least one reservoir that is at least partially filled with a liquid, wherein an upper surface of the liquid forms a total internal reflection surface configured to reflect light;

a first optical feature towards which light reflected by the total internal reflection surface is directed when the dynamic optic is in a first rotational orientation;

a second optical feature towards which light reflected by the total internal reflection surface is directed when the dynamic optic is in a second rotational orientation different from the first rotational orientation; and at least one light source disposed adjacent to the dynamic optic, wherein:

at least some of the light emitted by the at least one light source is reflected by the total internal reflection surface; and no light reflected by the total internal reflection surface is directed toward the second optical feature when the dynamic optic is in the first rotational orientation.

13. The light assembly of claim 12, wherein the reservoir comprises a rectangular cross-section.

14. The light assembly of claim 13, wherein a lower portion of the dynamic optic comprises a recess on a lower surface to accommodate the at least one light source.

15. The light assembly of claim 12, wherein the liquid comprises a liquid silicone having an different index of refraction than the dynamic optic.

16. The light assembly of claim 12, wherein the total internal reflection surface extends in a plane and wherein the plane does not change regardless of the rotational orientation of the dynamic optic.

17. The light assembly of claim 12, wherein the total internal reflection surface extends in a plane and wherein the total internal reflection surface reflects light at an angle from 10° to 60° with respect to an axis normal to the plane.

18. The light assembly of claim 12, wherein the dynamic optic rotates beyond a threshold angle to move from the first rotational orientation to the second rotational orientation.

19. A light assembly comprising:

a dynamic optic comprising at least one reservoir that is at least partially filled with a liquid, wherein an upper surface of the liquid forms a total internal reflection surface; and at least one light source disposed adjacent and fixed to the dynamic optic, the at least one light source movable with the dynamic optic, wherein at least some of the light emitted by the at least one light source is reflected by the total internal reflection surface.

20. The light assembly of claim 12, wherein the at least one light source is movably fixed to the dynamic optic.

* * * * *